US012789037B2

(12) United States Patent
Hara

(10) Patent No.: US 12,789,037 B2
(45) Date of Patent: Nov. 10, 2026

(54) CABLE ATTACHMENT SYSTEMS AND METHODS

(71) Applicant: Peloton Interactive, Inc., New York, NY (US)

(72) Inventor: Sherwood Kolea Hara, Seattle, WA (US)

(73) Assignee: Peloton Interactive, Inc., New York, NY (US)

( * ) Notice: Subject to any disclaimer, the term of this patent is extended or adjusted under 35 U.S.C. 154(b) by 114 days.

(21) Appl. No.: 18/670,616

(22) Filed: May 21, 2024

(65) Prior Publication Data

US 2024/0390728 A1 Nov. 28, 2024

Related U.S. Application Data

(60) Provisional application No. 63/503,694, filed on May 22, 2023.

(51) Int. Cl.
*A63B 21/00* (2006.01)

(52) U.S. Cl.
CPC ..... *A63B 21/4035* (2015.10); *A63B 21/151* (2013.01)

(58) Field of Classification Search
CPC ..... A63B 21/151; A63B 21/4035; A63B 21/4043
See application file for complete search history.

(56) References Cited

U.S. PATENT DOCUMENTS

| | | | | |
|---|---|---|---|---|
| 6,692,415 | B1 | 2/2004 | Winston | |
| 7,662,073 | B1 * | 2/2010 | Baldwin | A63B 21/4001 482/92 |
| 8,882,642 | B2 * | 11/2014 | Chavez | A63B 23/03575 482/121 |
| 9,370,685 | B2 * | 6/2016 | Watry | A63B 21/4035 |
| 11,247,092 | B2 * | 2/2022 | Albert Garcia | A63B 21/0552 |
| 12,042,689 | B2 * | 7/2024 | Leipheimer | A63B 21/4019 |
| 12,186,617 | B2 * | 1/2025 | Watry | A63B 21/4035 |
| 12,296,227 | B2 * | 5/2025 | Bui | A63B 43/02 |
| 2006/0211552 | A1 | 9/2006 | Williams | |
| 2010/0144501 | A1 | 6/2010 | Berhanu | |
| 2017/0296860 | A1 * | 10/2017 | Watry | A63B 21/4035 |
| 2020/0164244 | A1 * | 5/2020 | Gilmore | A63B 21/151 |
| 2022/0395716 | A1 * | 12/2022 | Leipheimer | A63B 21/4019 |

FOREIGN PATENT DOCUMENTS

WO WO 2012/033981 3/2012

* cited by examiner

*Primary Examiner* — Joshua Lee

(74) *Attorney, Agent, or Firm* — Haynes and Boone, LLP

(57) ABSTRACT

Systems and methods include a cable end grip assembly configured to attach to an end of an exercise cable, including a pliable strap having a first end adapted to attach to the end of the exercise cable and a second end including an attachment point adapted for connection to a cable attachment, and a grip structure adapted to engage the pliable strap between the first end and the second end, the grip structure and pliable strap adapted to provide a grip interface for a cable exercise. A multi-profile grip may be adapted for exercise equipment including a grip body having an elongated shaped adapted for gripping by a hand, the grip body having a first portion having a first shape adapted for pulling exercises, and a second portion having a second shape adapted for pushing exercises, wherein the second shape is different than the first shape.

20 Claims, 14 Drawing Sheets

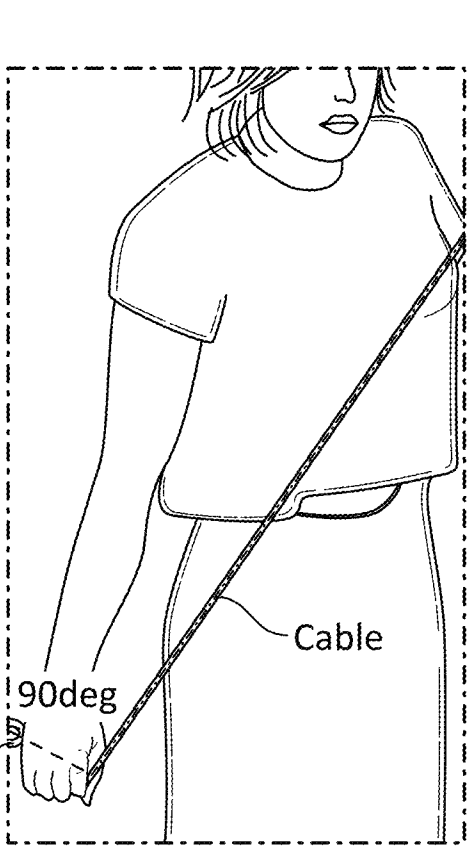
FIG. 2A
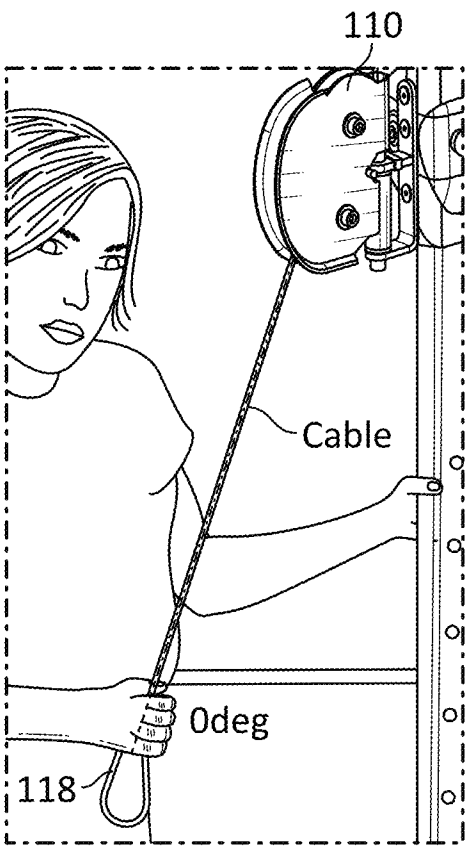
FIG. 2B
FIG. 2C

CABLE ATTACHMENT SYSTEMS AND METHODS

CROSS REFERENCE TO RELATED APPLICATIONS

This application claims priority to and the benefit of U.S. Provisional Patent Application No. 63/503,694 filed May 22, 2023 and entitled "CABLE ATTACHMENT SYSTEMS AND METHODS," which is incorporated herein by reference in its entirety.

BACKGROUND

The disclosed subject matter relates generally to exercise equipment, and in some embodiments, for example, to cable attachment systems and methods for exercise equipment.

Gyms often have cable stations with attachment points for connecting a carabiner or threaded link to various exercise attachments. The cables on these stations are prone to wear and tear and breakage, particularly when exercisers operate the machines outside of the machine's designed use. It is common, for example, for an exerciser to grab a cable by the fittings and do triceps extensions, which bends the cable repeatedly, fatiguing the steel fibers and leading to breaking cables. This can lead to injury or poorly performing or broken machines.

Cable-based systems are also commonly used for strength training and suspension training routines in which the users quickly switch between pushing and pulling exercises. When switching in this manner, standard round grips can be uncomfortable and may concentrate the load on the user's palm during pushing exercises. Some conventional systems include multiple sets of grips or grips with a wider center. However, these solutions can be costly or require equipment modification.

In view of the foregoing, it is desirable to provide new exercise systems and methods for cable attachments that address one or more of the drawbacks of conventional systems.

SUMMARY

The present disclosure is directed to various improved cable attachment systems and methods for exercise equipment. In some embodiments, a multi-profile grip is disclosed that allows for comfortable use during both pulling and pushing exercises.

In some embodiments, a cable molded grip and/or fabric strap are disclosed that may be used as cable attachments for adjustable-height cable stations, such as a multi-station selectorized weight machine, and other cable equipment.

The scope of the present disclosure is defined by the claims, which are incorporated into this section by reference. A more complete understanding of the present disclosure will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Various objects, features, and advantages of the disclosed subject matter can be more fully appreciated with reference to the following detailed description of the disclosed subject matter when considered in connection with the following drawings, in which like reference numerals identify like elements.

FIGS. 2A, 2B, and 2C illustrate an exercisers using the device at the end of the cable to perform triceps extensions.

DETAILED DESCRIPTION

The present disclosure describes various improved cable attachment systems and methods for use with exercise equipment.

In some embodiments, cable attachments are designed for use on an adjustable-height cable station, such as in a gym's multi-station selectorized weight equipment area. The ends of the cables on these machines often have some an attachment point for attaching a carabiner or threaded link, and then attaching other attachments to the carabiner or link. For adjustable-height cable stations, there is typically a device to prevent the cable end parts from getting pulled back into the pulleys while adjusting the height of the pulley carriage.

Figure 1A:
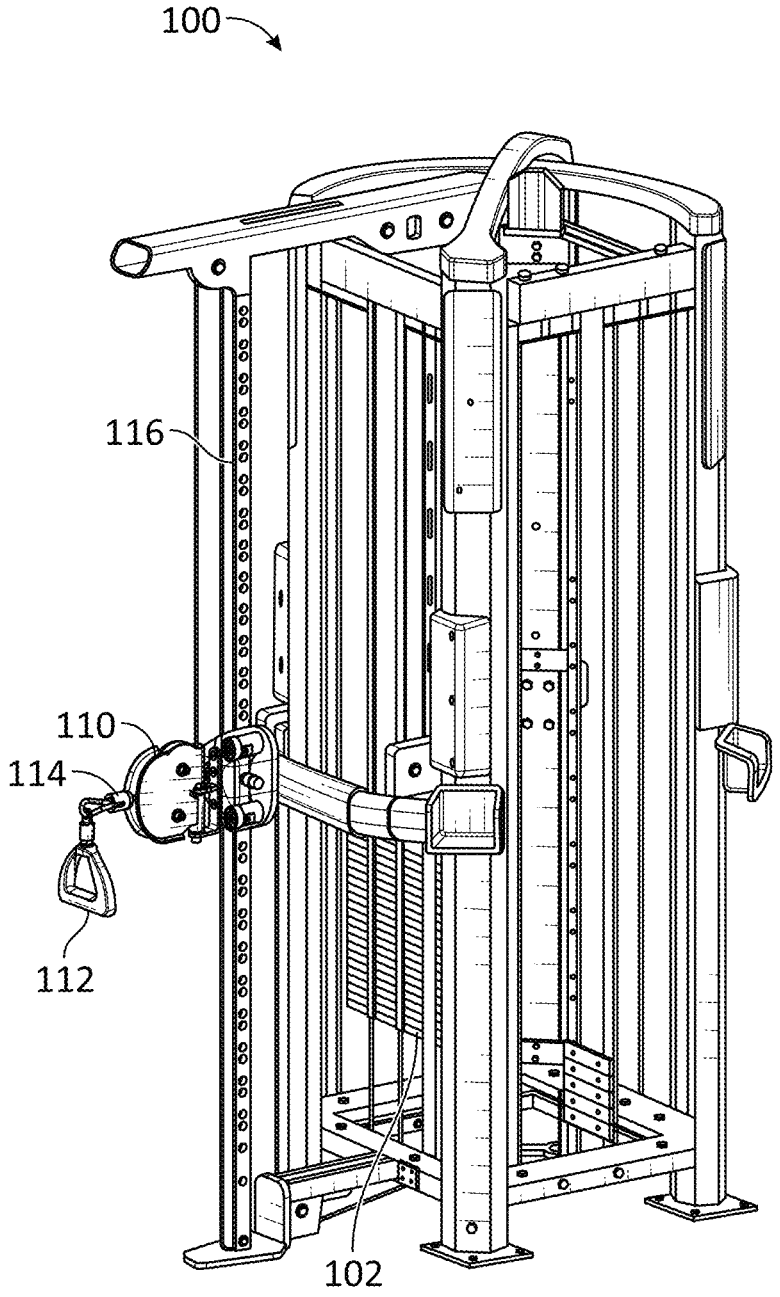
FIG. 1A shows an example cable machine.

Referring to FIG. 1, an example an adjustable-height cable station 100 will now be described. The cable station 100 includes a weight stack 102 allowing a use of the cable station 100 to select the resistance to be applied to a cable accessed through a cable attachment 112 (e.g., a handle). The end of the cable 114 in this system has an attachment point for attaching a carabiner or threaded link, which connects to the cable attachment 112. The height of the cable 114 is adjustable through a pulley carriage 110 that may be selectively positioned along a track 116.

Figure 1B:
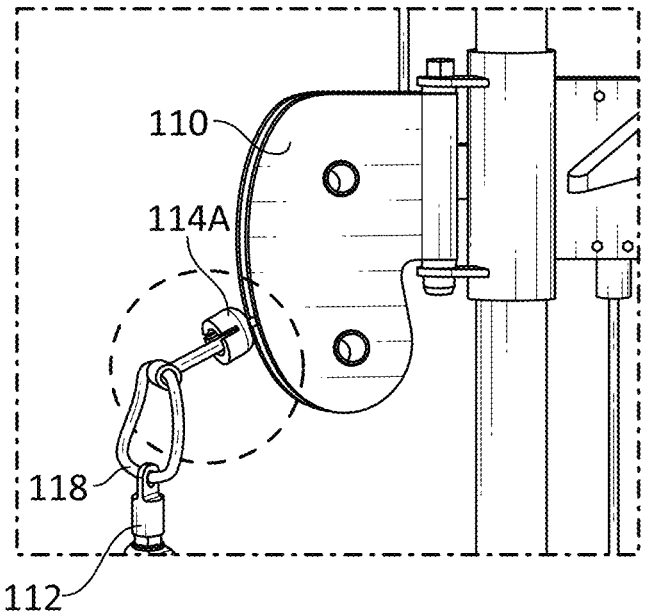
FIGS. 1B & 1C show example devices at the end of a cable.
Figure 1C:
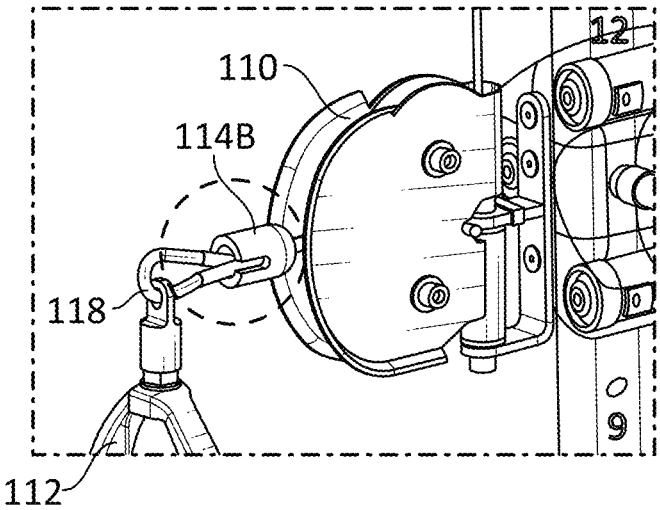

There is typically a device to prevent the cable end parts from getting pulled back into the pulley while adjusting the height of the pulley carriage 110. As illustrated in FIG. 1B, the end of the cable includes a ball 114A on the end of the cable preventing the cable end parts from pulling back into the pulley carriage 110. As illustrated in FIG. 1C, the cable end housing 114B in this example is large enough to prevent the cable end from pulling back into the pulley carriage 110. Attached to the ball 114A/housing 114B is a carabiner 118, which may be attached to a handle 112 or other attachment.

These devices at the end of the cables also facilitate use of the cable without attachments, which can lead to problems as discussed herein. Referring to FIGS. 2A-C, a problem is created because exercisers will often grab that device (e.g., carabiner 118 or housing 114B in the example figures) to do triceps extensions, which bends the cable repeatedly, fatiguing the steel fibers and leading to breaking cables. This can lead to exerciser injury or machines being out-of-order.

Figure 3:
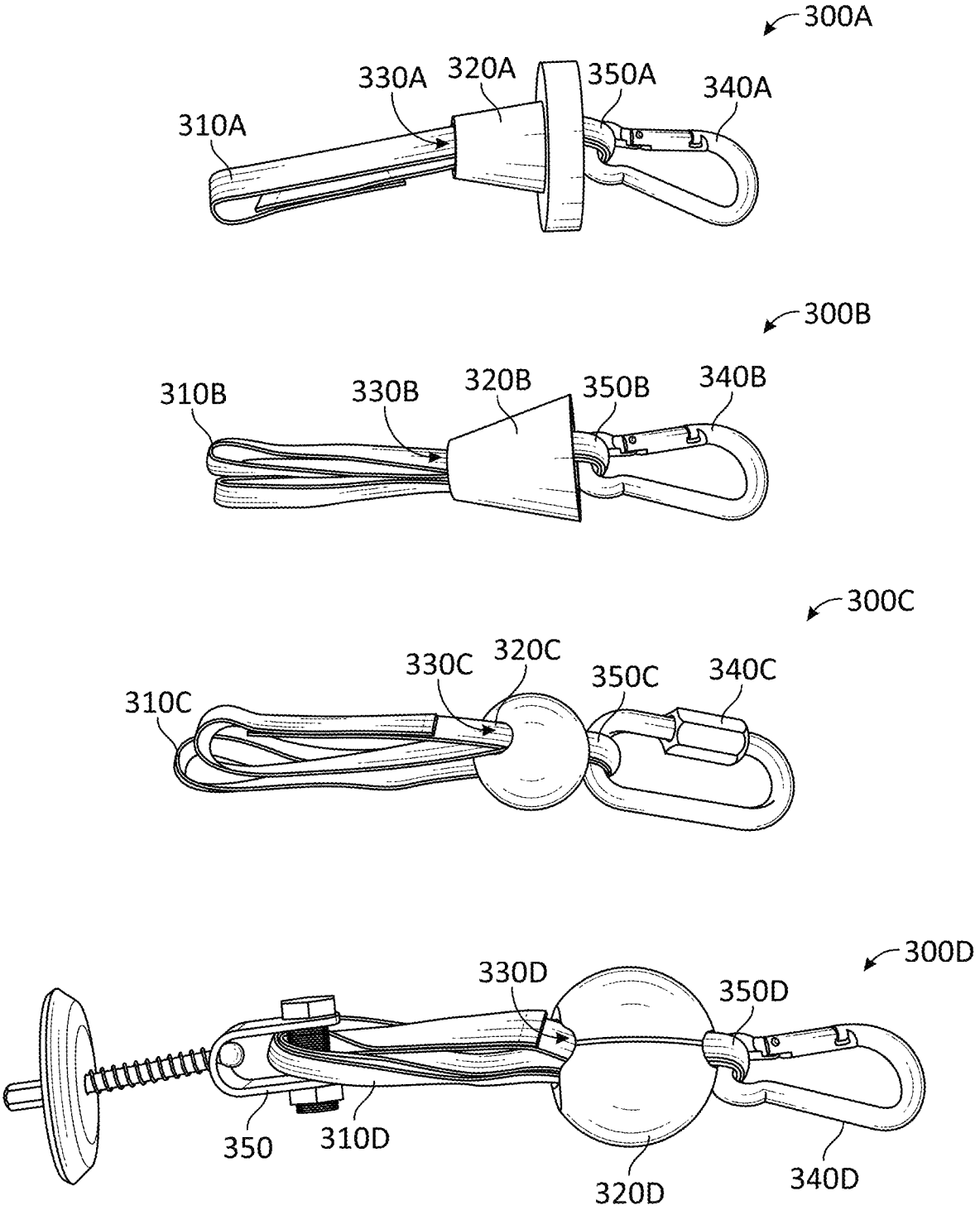
FIG. 3 illustrates example cable attachments including a molded grip with pliable portion, in accordance with one or more embodiments of the present disclosure.

The present disclosure solves the above-mentioned problem by providing a unique cable molded grip and pliable strap. FIG. 3 illustrates various examples of molded grip cable attachments 300A-D, in accordance with one or more embodiments of the present disclosure. In various embodiments, a pliable strap 310A-D is attached to the attachment point at the end of the cable, and a molded grip 320A-D is attached to the pliable strap 310A-D, respectively. The molded grip 320A-D includes one or more holes 330A-D, respectively, for the pliable strap 310A-D to pass back through. A carabiner 340A, 340B or 340D, for example, or threaded link 340C, may be attached to the little strap loop 350A-D extending from a hole at the end of the molded grip 320A-D.

Figure 4A:
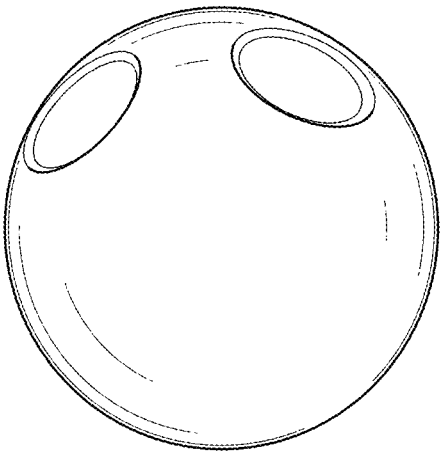
FIGS. 4A, 4B, 4C, and 4D show example molded grip shapes including a ball, a plug, a disk, and a plug with a disk, respectively, in accordance with one or more embodiments of the present disclosure.
Figure 4B:
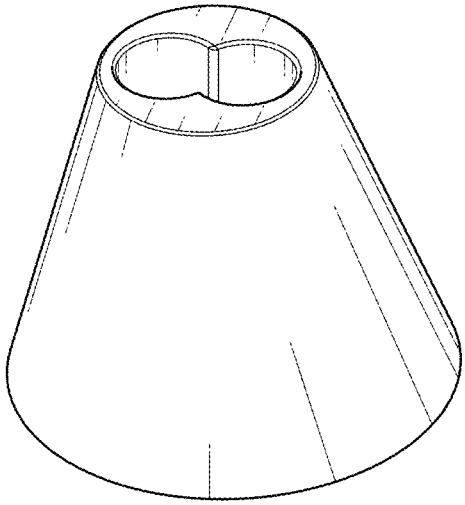
Figure 4C:
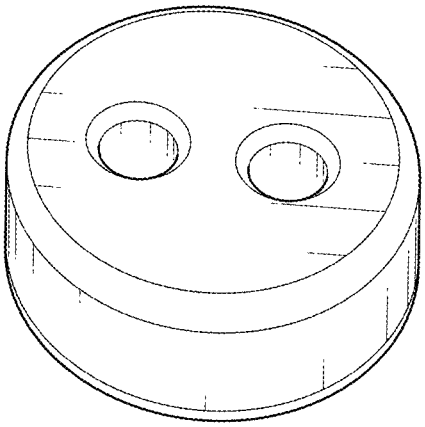
Figure 4D:
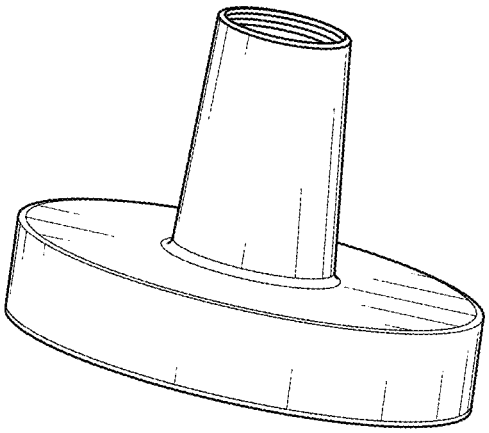
Figure 5C:
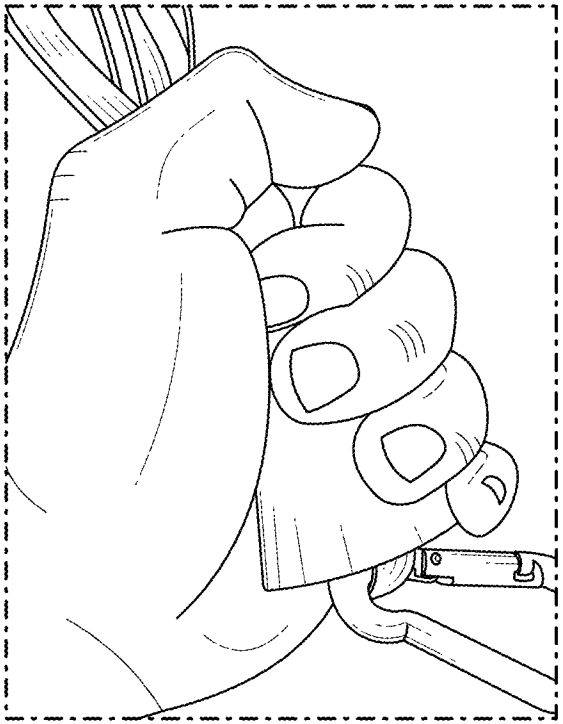
FIGS. 5A, 5B, and 5C show example grip shapes including a ball, a plug, a disk, and a plug with a disk, respectively, in accordance with one or more embodiments of the present disclosure.
Figure 5B:
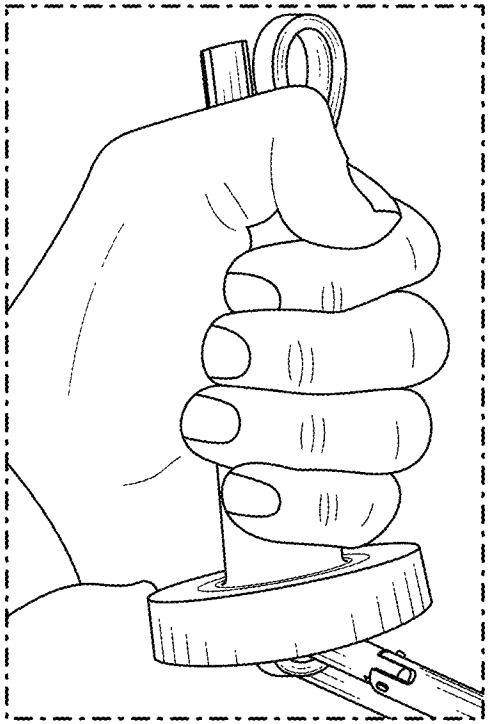
Figure 5A:
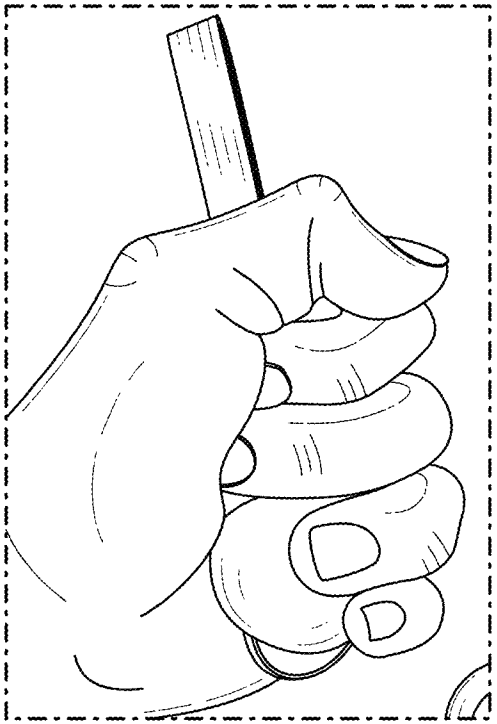

The molded grip may be implemented in a variety of ergonomic shapes, including a large ball 320D or a small ball 320C (see also FIG. 4A), a wedge/plug shape 320B (see also FIG. 4B), a smaller plug with a disk 320A (see also FIG. 4D), a flat disk without a plug shape extending from it (see also FIG. 4C), or other appropriate shape. In various embodiments, the shape is selected to fit easily into exercisers' hands and give them an intentional grip-point to grab for doing triceps extensions. Example grip points for triceps extensions are illustrated in FIG. 5A (ball molded grip), FIG. 5B (disk/plug molded grip), and FIG. 5C (plug molded grip).

The pliable strap can bend in any direction without fatiguing and eventually breaking, unlike the steel cable. Additionally, the pliable strap is soft, which reduces the chances of a user getting their hand pinched by it. In various embodiments, the molded grip 320A-D may be made of rubber, plastic, or other suitable robust but lightweight material(s), such as lighter die-cast metals such as aluminum. In various embodiments, the pliable strap may be made of a rugged fabric or similar material providing the pliability described herein.

In some embodiments, the molded grip 320A-D has one or two holes formed therethrough. Having two holes allows an arrangement in which the molded grip 320A-D is trapped on the strap 330A-D. In some embodiments, a fabric sleeve could be provided to cover the straps 330A-D from the end of the molded grip 320A-D to a U-bracket 350, to keep the straps together and present a mono-body look. The molded grip and pliable strap described herein can be attached to any adjustable pulley cable station. When not being used for single arm triceps extensions, users can attach the other standard attachments to the carabiner for using the station in typical fashion.

The embodiments described herein solve the problem of cables breaking from exercisers using them improperly. The cable molded grip and fabric strap provide an intentional grab-point for exercisers to do triceps extensions and other exercises preventing the exercisers from grabbing the cable by the fittings and bending the cable repeatedly. Use of the cable molded grip and fabric strap may lead to more equipment uptime and less risk of injury.

Figure 6:
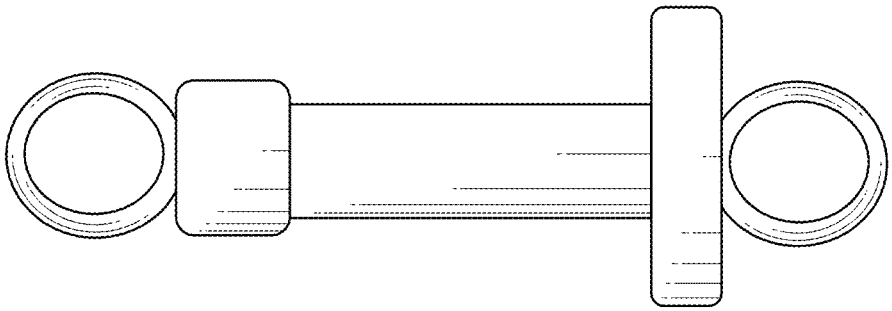
FIG. 6 shows another example of a cable attachment, in accordance with one or more embodiments of the present disclosure.

In some embodiments, a single rope attachment and/or a short length of rope or chain could possibly be used instead of the strap, with or without the molded shape depending on the thickness (see, e.g., FIG. 6). However, these alternatives are not as effective in providing an intentional grab-point and preventing the cables from breaking. As will be readily understood by those skilled in the art, the present disclosure is a significant improvement over conventional systems.

Figure 7:
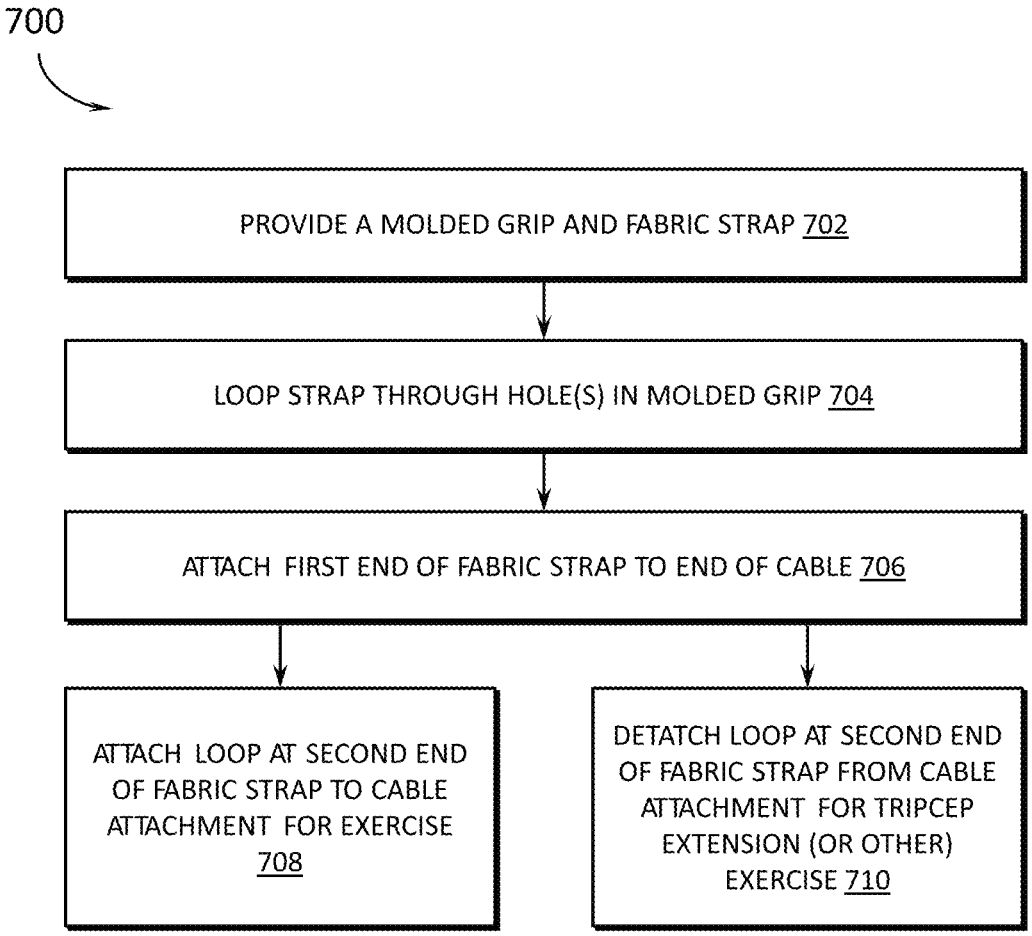
FIG. 7 is an example method for using the molded grip and pliable strap, in accordance with one or more embodiments of the present disclosure.
Figure 8A:
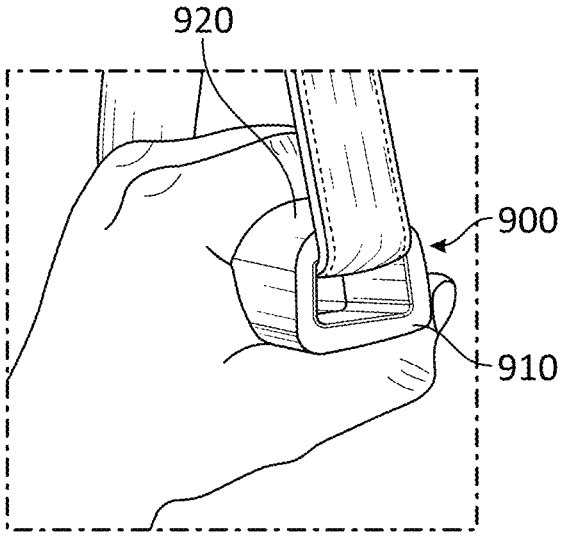
FIGS. 8A and 8B show an example multi-profile grip during a pulling exercise, in accordance with one or more embodiments of the present disclosure.
Figure 8B:
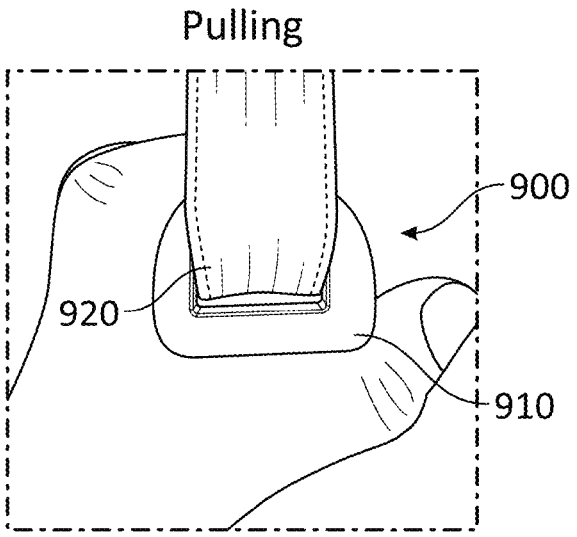
Figure 8C:
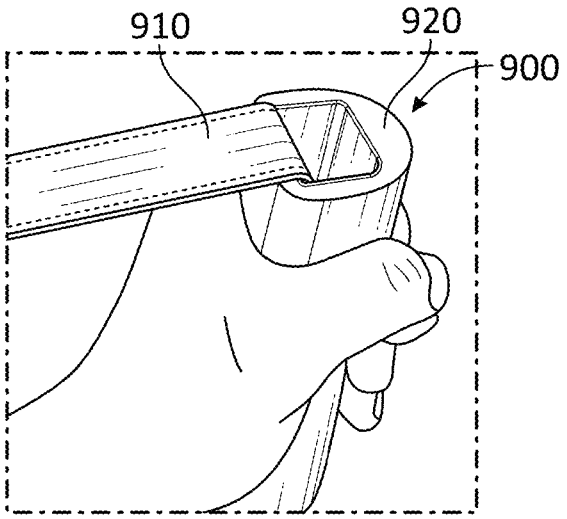
FIGS. 8C and 8D show an example multi-profile grip during a pushing exercise, in accordance with one or more embodiments of the present disclosure.
Figure 8D:
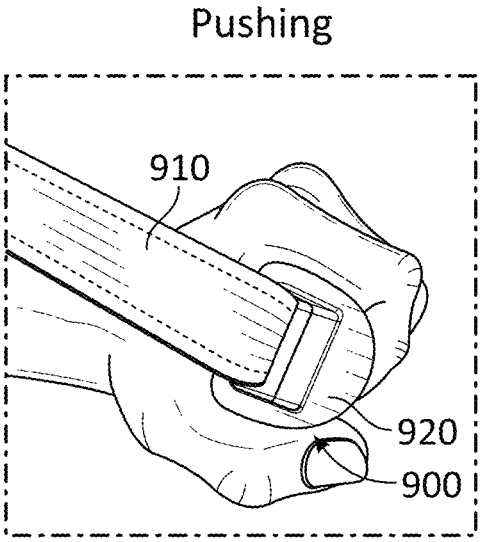
Figures 9A, 9B:
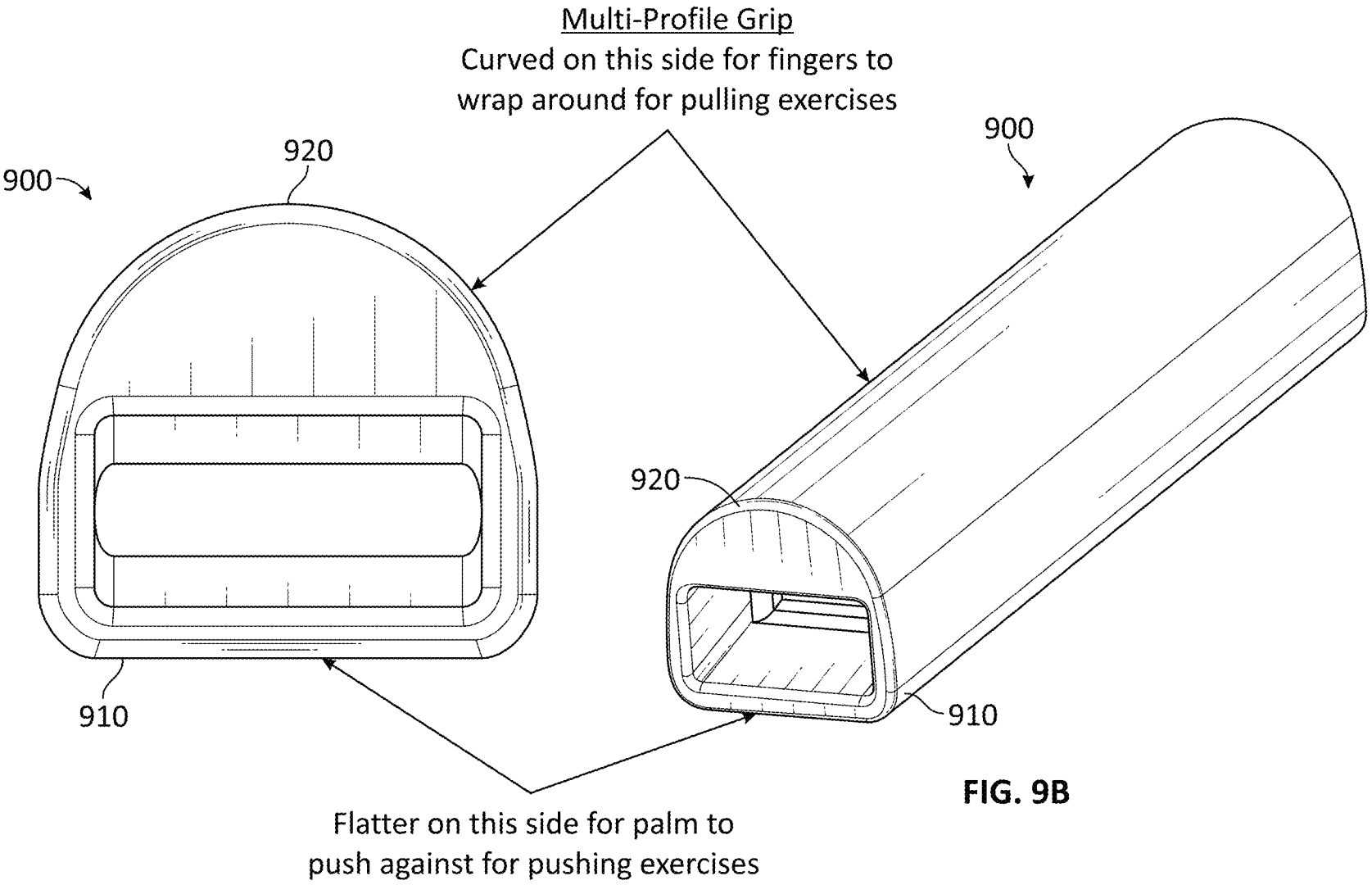
FIGS. 9A and 9B show side and perspective views of a multi-profile grip, in accordance with one or more embodiments of the present disclosure.

An example method 700 for using an implementation of a molded grip and pliable strap of the present disclosure will now be described with reference to FIG. 7, in accordance with one or more embodiments. In block 702, a molded grip and fabric strap are provided. The molded grip and fabric strap may be implemented in various designs consistent with the present disclosure, including the designed illustrated in FIGS. 3-5C.

In block 704, the fabric strap is looped through the hole(s) in the molded grip. In block 706, a first end of the fabric strap is attached to the end of a cable on a machine (e.g., via a U-bracket). In block 708, the loop at the second end of the fabric strap is attached to a cable attachment (e.g., rope attachment, straight bar attachment, etc.) for exercise using the cable attachment. In block 710, the cable attachment is detached from the fabric strap allowing the fabric strap and molder grip to be used for triceps extensions (or another exercise as appropriate).

Multi-Profile Grip

Exercise equipment such as TRX straps and various cable-based machines are commonly used for strength training and suspension training During exercise, users often switch between pushing and pulling exercises, but standard round grips can be uncomfortable and may concentrate the load on the user's palm during pushing exercises. Some conventional approaches include multiple sets of grips or grips having a wider center. However, these solutions can be costly or require equipment modification.

The present disclosure provides a multi-profile grip that addresses the problem of uncomfortable grip during pushing exercises. The multi-profile grip may be implemented as a cable attachment which may be attached to a carabiner at the end of a cable, such as a carabiner attached to a molded grip and fabric strap as disclosed with reference to FIGS. 1-7 or other cable attachment system.

Referring to FIGS. 8A-D and 9A-B, the multi-profile grip 900 is a substantially cylindrical grip that is divided into two distinct sections: (i) a smaller radius side 920 for wrapping fingers around during pulling exercises, and (ii) a larger radius side 910 for placing the palm during pushing exercises. The multi-profile grip is designed to be used with suspension training equipment, strength training equipment, and cable-based strength equipment.

The grip may be made of any suitable material, such as rubber or foam. The grip may be secured to the exercise equipment using any suitable means, such as a screw or clamp. In some embodiments, the grip may be implemented as a cable attachment for use with a cable machine. The multi-profile grip may be used with a variety of exercise equipment, including suspension training equipment like TRX, strength training equipment like Cobra, and cable-based strength equipment.

The multi-profile grip solves the problem of uncomfortable grip during pushing exercises on exercise equipment. This grip provides a cost-effective and simple solution for users who switch between pulling and pushing exercises on a regular basis.

In various embodiments, the cable attachments and grips of the present disclosure may be used with other exercise equipment, sensors, and processing systems. For example, a system and method may be performed by a processing system and camera that includes receiving a sequence of camera images of a user performing an exercise using a cable attachment and/or grip disclosed herein, identifying a plurality of anatomical points of the user from the sequence of camera images, and determining user performance information for the exercise based on an analysis of the plurality of anatomical points. The method may further include applying exercise performance rules including criteria for satisfactory performance of the exercise and providing corrective feedback to the user for exercise performance rules that are not met by the user performance information.

In some embodiments, exercises performed with a cable attachment and/or or grip as disclosed herein may include a plurality of movement stages to be performed in sequence and determining the user performance information for the exercise may further include analyzing the plurality of anatomical points to determine whether the user has performed the movement associated with each of the movement stages of the exercise. The method may further include displaying exercise content associated with the exercise on a display device while the sequence of camera images is captured.

In some embodiments, a display device may be configured to display exercise content to guide the user of the cable attachment/grip through an exercise session.

In some embodiments, cable or suspension exercises to be performed by a user of the cable attachment/grip may have associated ground truth values represented as a sequence of anatomical angles and/or positions, and the user performance information may include comparison results between the ground truth values for the exercise and the identified plurality of anatomical points of the user. In some embodiments, a score may be calculated for the user's performance of the exercise based on comparison results between the ground truth values for the exercise and the identified plurality of anatomical points of the user. A user interface may be presented on the display device that includes a summary of the exercise including feedback associated with the user's performance of the exercise In some embodiments, various sensor configurations may be implemented in or with the cable attachment/grip. The cable attachment/grip may be part of an exercise system that includes various sensors configured to detect one or more characteristics of the system, such as weight, reps, etc. For example, the exercise system may include one or more imaging sensors, inertial measurement units (IMUs), load cells, or force sensors. The sensors may be used to track and monitor use of the cable attachment/grip and/or the user. For instance, the sensors may be used to track user movement, identify errors, and monitor loads, among others. Such sensor information may be used to calibrate the system, perform one or more system checks, and/or provide feedback to a user of the exercise system, such as feedback regarding exercise performance and other metrics.

In various embodiments, an apparatus includes a cable end grip assembly configured to attach to an end of an exercise cable, including a fabric strap having a first end adapted to attach to the end of the exercise cable and a second end comprising an attachment point adapted for connection to a cable attachment, and a grip structure adapted to engage the fabric strap between the first end and the second end, the grip structure and fabric strap adapted to provide a grip interface for a cable exercise.

The cable end grip assembly may be configured for use in an adjustable-height cable station and/or a cable resistance equipment. The grip structure may include molded rubber, plastic, and/or metal having at least one through-hole through which the fabric strap passes, and the fabric strap is passed through the through-hole between the first end and the second end. The attachment point includes a fabric strap loop extending from an end of the at least one through-hole of the grip structure. The fabric strap loop is adapted for attachment to a carabiner and/or a threaded link, and/or the first end of the fabric strap is adapted to attach to a U-bracket attachment point for the cable end.

The grip structure may have a shape including a ball, a plug, a plug with a disk, and/or a flat disk. The apparatus may further include a fabric sleeve covering the fabric strap from the end of the grip structure to first end.

In various embodiments, a method of mitigating damage to exercise cables includes providing a cable end grip assembly configured to attach to an end of an exercise cable, comprising a fabric strap having a first end adapted to attach to the end of the exercise cable and a second end comprising an attachment point adapted for connection to a cable attachment, and a grip structure adapted to engage the fabric strap between the first end and the second end, the grip structure and fabric strap adapted to provide a grip interface for a cable exercise, attaching the fabric strap to an attachment point of the cable end, passing the fabric strap through at least one hole in the grip structure, and attaching a fabric strap loop extending from the hole of the grip structure to an attachment structure.

The method may further include covering the fabric strap with a fabric sleeve from an end of the grip structure to the first end of the fabric strap. The attachment structure may include a carabiner, and the method may further include attaching a multi-profile grip to the carabiner, the multi-profile grip including an elongated body having a substantially flat side adapted for pushing exercises and a curved side adapted for pulling exercises, and performing an exercise using the fabric strap and grip structure as a handle for pulling the cable.

In some embodiments, an apparatus includes a multi-profile grip adapted for exercise equipment including a grip body having an elongated shaped adapted for gripping by a hand, the grip body having a first portion having a first shape adapted for pulling exercises, and a second portion having a second shape adapted for pushing exercises, wherein the second shape is different than the first shape.

The multi-profile grip may be adapted to be removably attached to an exercise equipment cable or attachment point. The grip body may be cylindrically-shaped and wherein the first portion is a curve-shaped portion with a smaller radius than the second portion, the first portion allowing a user's fingers to wrap around the curve shape during pulling exercises. The grip body may be cylindrically-shaped and wherein the second portion is a substantially flat-shaped portion with a larger radius than the first portion, the second portion allowing a user's palm to push on the substantially flat-shaped portion during pushing exercises. The multi-profile grip may comprise rubber or foam. The method may further include switching between the first portion for pulling exercises and the second portion for pushing exercises during exercise.

In various embodiments, a method includes providing a multi-profile grip adapted for exercise equipment comprising a grip body having an elongated shaped adapted for gripping by a hand, the grip body having a first portion having a first shape adapted for pulling exercises, and a second portion having a second shape adapted for pushing exercises, wherein the second shape is different than the first shape, attaching the multi-profile grip to exercise equipment comprising suspension training equipment, strength training equipment, and/or cable-based strength equipment, and switching between the first portion for pulling exercises and the second portion for pushing exercises during exercise.

Example Cable Fittings

Example cable fittings that may be disposed between a cable and a carabiner/attachment will now be described with reference to FIGS. 10A-E, in accordance with one or more embodiments.

As previously discussed, users of pulley stations on selectorized equipment (or other exercise equipment that includes a resistance cable/band/pulley or similar arrangement) often grab the cable by whatever is on the end of the cable (typically a ball or other easy-to-grab shaped object) and do triceps extensions or similar exercises. This causes the cable to bend over the edge of the ball or fitting at the end of the cable (see, e.g., FIGS. 2B & 2C), fatiguing the steel cable fibers and leading to cable breaks, unusable equipment, and possible injuries.

One approach addresses this wear-and-tear (i.e., cable wear at that edge of the fitting), by replacing the fitting with a disk and barrel yoke that less adaptable to grabbing by a user. However, users continue to look for ways to grab the cable fitting and this barrel-yoke approach may actually result in cables wearing faster than the previous ball-style fittings. In a test environment, for example, a simulated triceps extension movement performed with a ball-style fitting resulted in cable wear in the 4000-8000 cycle range, while the barrel-yoke fitting resulted in cable wear in as little as 200 cycles.

Referring to FIGS. 10A-E, a novel fitting 1000 has a radiused surface for the cable 1030 to bend around as the fitting 1000 rotates, decreasing fatigue of the cable 1030 (e.g., steel cable fibers) and lowering the risk of the cable 1030 breaking. The fitting 1000 includes a housing 1010, which may be made of molded plastic or other suitable material commonly used in fitness equipment (e.g., hard rubber, plastic, etc.), that includes a top opening 1012, a bottom opening 1014 adjoining the top opening 1012, and a through-hole 1016 formed through the sides of the housing 1010 through an opening located in an interior of the housing 1010.

The housing 1010 is adapted to receive the cable 1030 through the top opening 1012. A ball shank 1032 (e.g., a metal ball shank) is attached at the end of the cable 1030 and is configured to be fed through the top opening 1012. A U-bracket 1050 may be inserted into the bottom opening 1014 and includes a slot 1052 and an enjoining hole 1054. The ball shank 1032 is adapted to have a diameter that is small than the diameter of the hole 1054, and larger than the adjoining slot 1052. The slot 1052 has a width that is larger than the diameter of the cable 1030 (allowing the cable to pass through) and smaller than the diameter of the ball shank 1032 (allowing the ball shank to hold the U-bracket 1050).

Figure 10B:
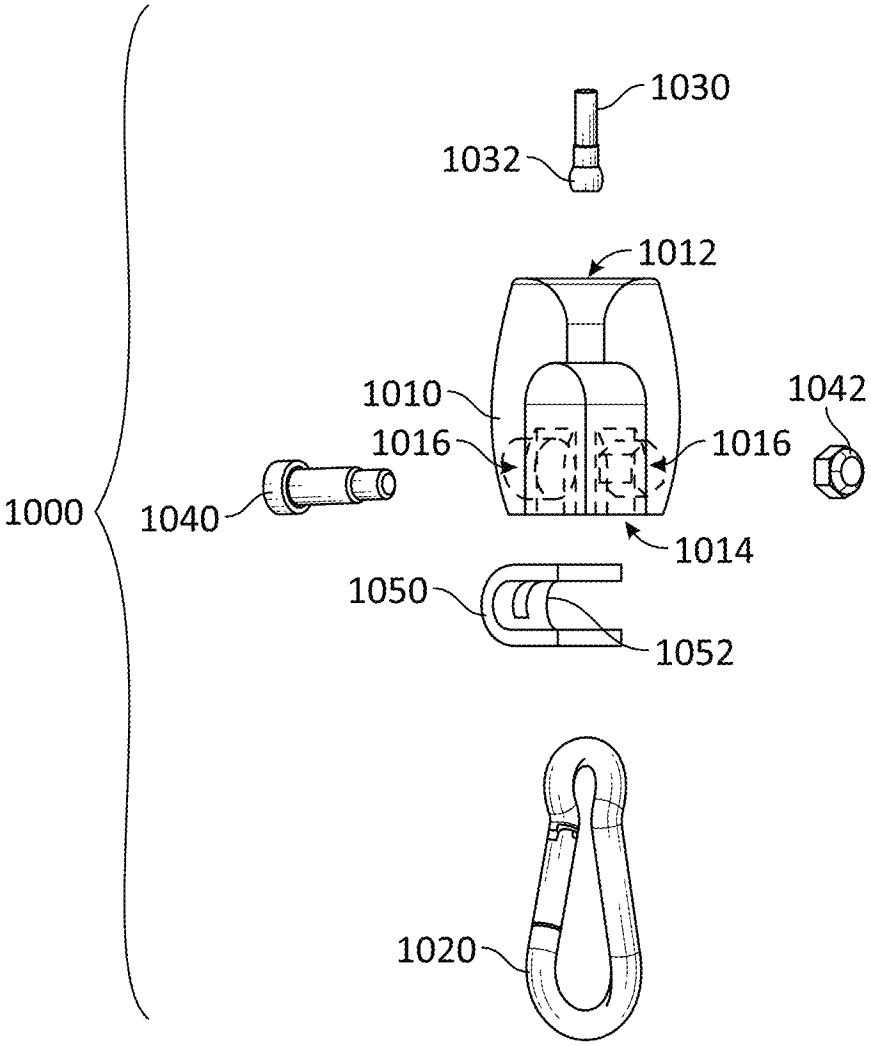
FIGS. 10A, 10B, 10C, 10D, and 10E illustrate various views of an example cable fitting that may be disposed between a cable and a carabiner/attachment, in accordance with one or more embodiments of the present disclosure.
Figure 10A:
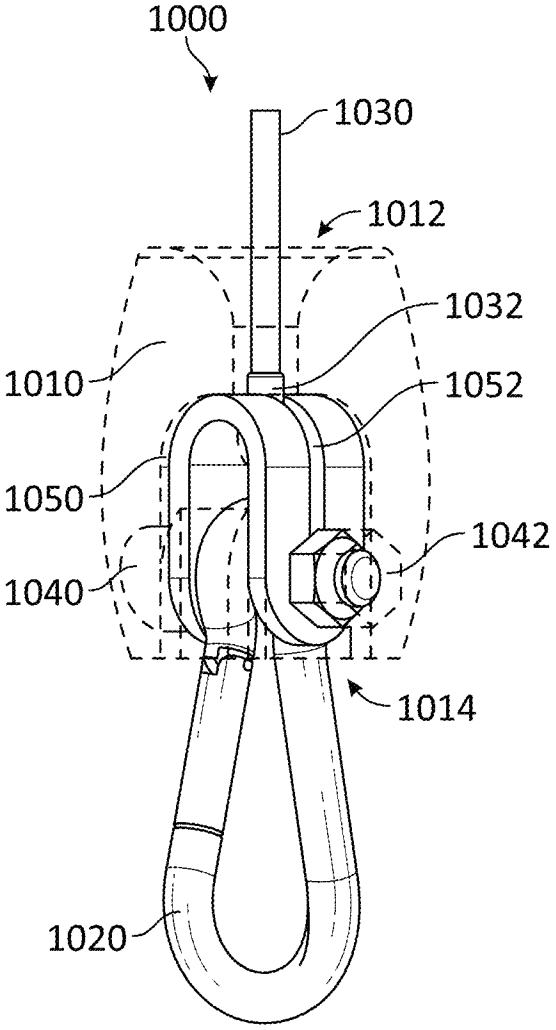
Figures 10C, 10D, 10E:
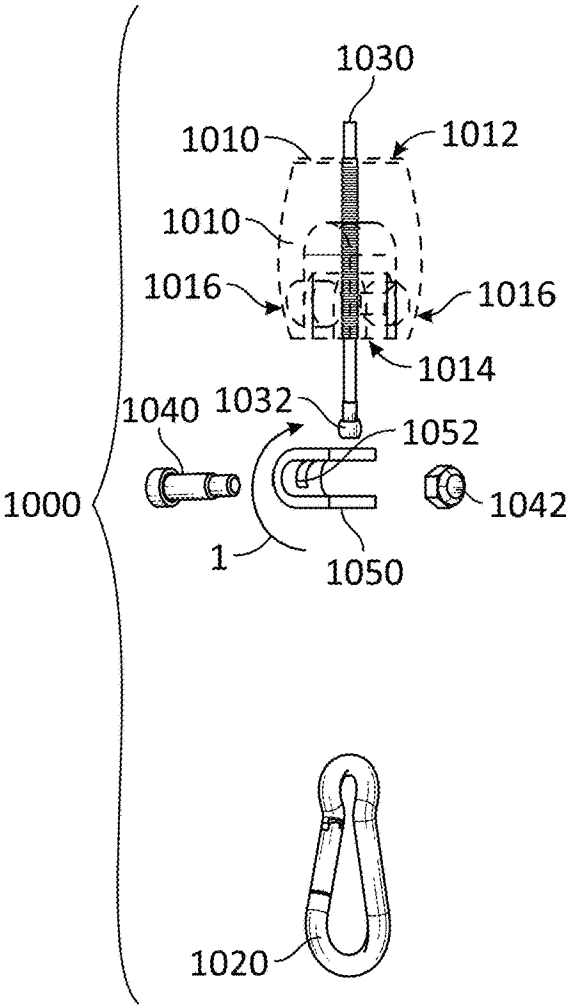

As illustrated in Step 1 of FIG. 10E, the ball shank 1032 is fed through the top of the housing 1010 and into the hole 1054 of the U-bracket 1050. The U-bracket 1050 is rotated along the slot 1052, allowing the cable 1030 to pass through the slot 1052 while the U-bracket 1050 is supported by the ball shank 1032 (Step 2 illustrated in FIG. 10D). Next, the housing 1010 may be lowered over the U-bracket 1050, which may be supported by an interior surface of the housing 1010 (Step 3 illustrated in FIG. 10C). In one embodiment, an interior of the housing (e.g., at a location where the top opening 1012 and bottom opening 1014 adjoin) includes a lip or shelf that allows the cable 1030 to pass through while supporting the U-bracket within the housing.

The holes 1054 and 1056 of the U-bracket 1050 have corresponding holes 1016 on the housing, which align to enable a bolt 1040 to pass through where it can be secured by a nut 1042 (Step 4 illustrated in FIG. 10C). A carabiner 1020 fits around the bolt 1040 to enable handle attachments to be used with the fitting 1000. In some embodiments, the carabiner 1020 may be positioned in the housing 1010 before the bolt 1040 is pushed through and attached to the housing 1010. Advantages of the novel fitting 1000 include ergonomic grip shape for users to grab, and a radiused surface to extend cable life. The parts can be removed so that only ball shank is left on end of cable, facilitating replacement of fitting parts and/or worn-out cables without having to remove pulleys. Further, the set up secures the carabiner to the fitting, making it harder for people to steal carabiners from the equipment.

As illustrated, the carabiner 1020 can rotate from the bottom opening 1014 of the housing 1010, allowing the fitting 1000 to be used with various handle attachments for exercise. The fitting 1000 may also be used for exercises without an attachment, such as the triceps exercise illustrated in FIGS. 2A-C. The top opening 1012 of the housing has a smooth, curved surface with a radius that gradually increases towards the top of the housing. In this arrangement, the fitting 1000 may be grabbed at various angles (e.g., 90-degrees) without undue wear on the cable 1030, by mitigating against crimping and/or bending of the cable at the fitting.

It will be appreciated that the fitting illustrated in FIGS. 10A-E is one possible implementation in which a housing having a radiused opening fits over a U-bracket that holds the carabiner. In other examples, a radiused opening (e.g., smooth surface, gradually increasing radius towards the top) that mitigates crimping/bending of the cable may be provided on a conventional or other fitting to prevent undue wear on the cable 1030.

In one example embodiment, an apparatus for connecting a handle to an end of a fitness cable includes a housing having an opening formed therethrough comprising a top opening and an adjoining bottom opening, and a bracket adapted to fit into the bottom opening of the housing, the bracket having a first hole and a slot adjoining the first hole. The cable may include a ball shank at a terminal end, the ball shank being adapted to fit into the first hole of the bracket and having a radius that is larger than a width of the slot. The bracket is configured to rotate facilitating travel of the cable along the slot into an installed position in which the bracket is secured to the cable via the ball shank. The housing is adapted to hold the bracket therein while allowing the cable to pass through the top opening which comprises a radiused or funnel-shaped opening.

Figure 11A:
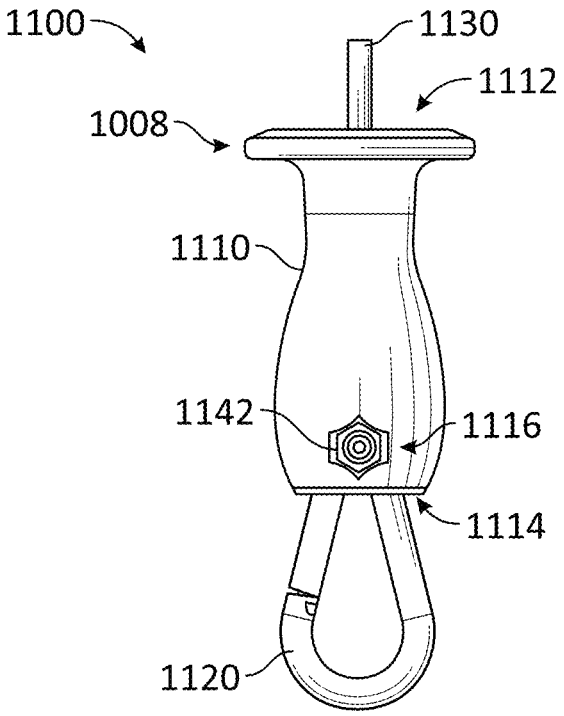
FIGS. 11A, 11B, and 11C illustrate a front view, a sectional view, and an exploded view, respectively, of another example cable fitting that may be disposed between a cable and a carabiner/attachment, in accordance with one or more embodiments of the present disclosure.
Figure 11B:
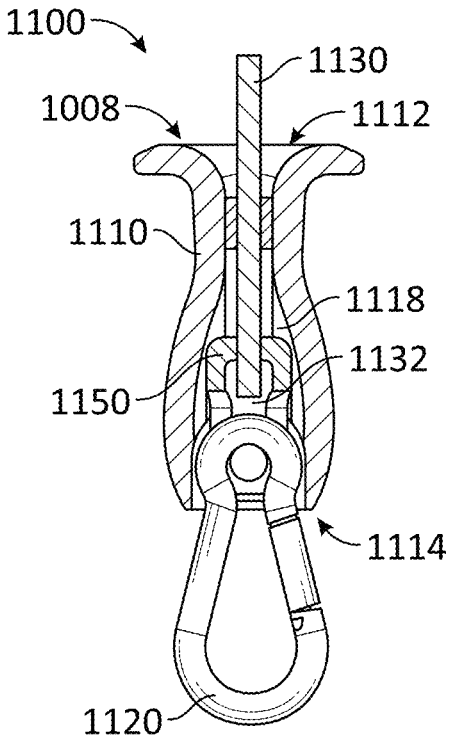
Figure 11C:
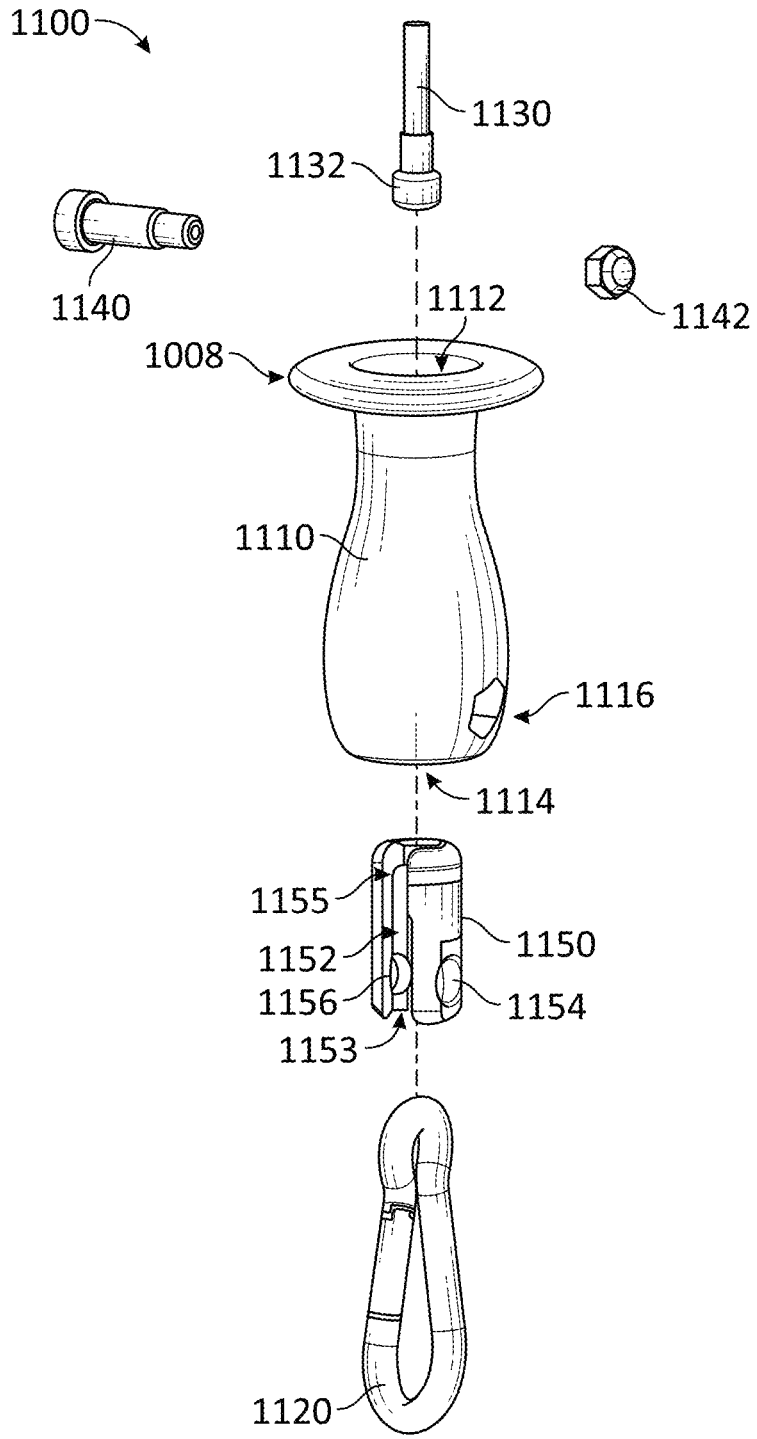

Referring to FIGS. 11A-C, another example novel fitting 1100 will now be described. Fitting 1100 has a radiused surface 1008 for the cable 1130 to bend around as the fitting 1100 rotates, decreasing fatigue of the cable 1130 and lowering the risk of the cable 1130 breaking. The fitting 1100 includes a housing 1110, which may be made of molded plastic or other suitable material commonly used in fitness equipment (e.g., hard rubber, plastic, etc.), that includes a top opening 1112, a bottom opening 1114 adjoining the top opening 1112, and a through-hole 1116 formed through the sides of the housing 1110 through an opening located in an interior of the housing 1110.

The housing 1110 is adapted to receive the cable 1130 through the top opening 1112. An anchor point cable termination, ball shank 1132 (e.g., a metal ball shank) in the illustrated embodiment, is attached at the end of the cable 1130 and adapted to be fed through the top opening 1112 and secured to the housing 1110. In some embodiments, the ball shank 1132 terminates the cable 1130 and includes a spherical, ball-shaped, or similar component at the end of the cable 1130 adapted to fit into a corresponding slot, socket or other receptacle, allowing for a secure and reliable connection between the cable 1130 and the housing 1110. The ball shape provides flexibility and enables multidirectional movement, making it suitable for movements that include articulation or rotation as described herein.

A bracket 1150 may be inserted into the bottom opening 1114 and includes a slot 1152 that is wider than the diameter of the cable 1130 and narrower than the ball shank 1132. The bracket 1150 includes an opening 1153 adjoining the slot 1152 and adapted to receive the ball shank 1132 allowing the cable 1130 to pass through the slot 1152 and out the top, where the ball shank 1132 is secured against a lip 1155 of the bracket 1152.

To attach the fitting 1100, the ball shank 1132 at the end of the cable 1130 is fed through the top opening 1112 of the housing 1110 and into the hole 1153 of the bracket 1150. The bracket 1150 is rotated along the slot 1152, allowing the cable 1130 to pass through the slot 1152 to a position in which the bracket 1150 is supported by the ball shank 1132. Next, the housing 1110 is lowered over the bracket 1150, which may be supported by an interior surface of the housing 1110. In the illustrated embodiment, the housing 1110 is shaped to facilitate gripping by a user's hand during exercise, and includes an interior surface portion 1118 that includes an opening narrower than the diameter of the bracket 1150, allowing the bracket 1150 to be supported within the housing 1150 during operation. In some embodiments, the interior surface portion 1118 may include a lip or other structure to block the bracket 1150 from passing through the housing 1110.

The holes 1154 and 1156 of the bracket 1150 have corresponding holes 1116 on the housing 1110, which align to enable a bolt 1140 to pass through where it can be secured by a nut 1142. A carabiner 1120 fits around the bolt 1140 to enable handle attachments to be used with the fitting 1100. In some embodiments, the carabiner 1120 may be positioned in the housing 1110 before the bolt 1140 is pushed through and attached to the housing 1110.

The installed fitting 1100 allows a user to perform exercises (e.g., triceps extensions) using the fitting 1100 as a grip/handle while mitigating wear and tear on the cable 1130. As illustrated, the radiused surface 1008 provides a smooth surface where the cable 1130 may contact during use. When viewed from above, the radiused surface 1008 has a round shape (e.g., circular or other rounded shape). The radiused surface 1008 has curved contour angles that transition smoothly from the interior of the housing 1100 adjacent to the bracket 1150 to the upper rim of the radiused surface 1008, providing a continuous and seamless surface without sharp edges or corners to unduly bend and/or crimp the cable 1130. In some embodiments, the diameter of the radiused surface varies throughout the height, increasing towards the rim, and the contour angles change gradually to avoid abrupt changes or irregularities in areas where the cable 1130 may contact during exercise.

Although the various embodiments have been described and illustrated in the foregoing disclosure, it is understood that the present disclosure has been made only by way of example, and that numerous changes in the details of implementation can be made without departing from the spirit and scope of the present disclosure. Features of the disclosed embodiments can be combined and rearranged in various ways.

What is claimed is:

1. An apparatus comprising:

a cable end grip assembly configured to attach to an end of an exercise cable, comprising:

a pliable strap having a first end adapted to attach to a U-bracket at the end of the exercise cable and a second end comprising an attachment point adapted for connection to a cable attachment; and a grip structure adapted to engage the pliable strap between the first end and the second end, the grip structure and pliable strap adapted to provide a grip interface for a cable exercise.

2. The apparatus of claim 1, wherein the cable end grip assembly is configured for use in an adjustable-height cable station and/or a cable resistance equipment.

3. The apparatus of claim 1, wherein the grip structure comprises molded rubber, plastic, and/or metal having at least one through-hole through which the pliable strap passes; and wherein the pliable strap passes through the through-hole between the first end and the second end.

4. The apparatus of claim 3, wherein the attachment point comprises a pliable strap loop extending from an end of the at least one through-hole of the grip structure; and wherein the pliable strap loop is adapted for attachment to a carabiner and/or a threaded link.

5. The apparatus of claim 3, wherein the grip structure has a shape comprising a ball, a plug, a plug with a disk, and/or a flat disk.

6. The apparatus of claim 1, further comprising a fabric sleeve covering the pliable strap from an end of the grip structure to the first end.

7. A method of mitigating damage to exercise cables comprising:

providing a cable end grip assembly configured to attach to an end of an exercise cable, comprising a pliable strap having a first end adapted to attach to a U-bracket at the end of the exercise cable and a second end comprising an attachment point adapted for connection to a cable attachment, and a grip structure adapted to engage the pliable strap between the first end and the second end, the grip structure and pliable strap adapted to provide a grip interface for a cable exercise;

attaching the first end of the pliable strap to the U-bracket of the cable end;

passing the pliable strap through at least one hole in the grip structure; and attaching a pliable strap loop extending from the hole of the grip structure to the cable attachment.

8. The method of claim 7, further comprising:

covering the pliable strap with a pliable sleeve from an end of the grip structure to the first end of the pliable strap.

9. The method of claim 7, wherein the cable attachment is a carabiner, and wherein the method further comprises:

attaching a multi-profile grip to the carabiner, the multi-profile grip comprising an elongated body having a substantially flat side adapted for pushing exercises and a curved side adapted for pulling exercises.

10. The method of claim 7, further comprising:

performing an exercise using the pliable strap and the grip structure as a handle for pulling the cable.

11. An apparatus comprising:

a multi-profile grip adapted for exercise equipment comprising:

a grip body having an elongated shape adapted for gripping by a hand, the grip body having a first portion having a first shape adapted for pulling exercises, and a second portion having a second shape adapted for pushing exercises;

wherein the second shape is different than the first shape;

further comprising a connection assembly for connecting the multi-profile grip to an end of a fitness cable, the connection assembly comprising:

a housing having an opening formed therethrough comprising a top opening and an adjoining bottom opening; and a U-bracket adapted to fit into the bottom opening of the housing, the U-bracket having a first hole and a slot adjoining the first hole.

12. The apparatus of claim 11, wherein the multi-profile grip is adapted to be removably attached to an exercise equipment cable or an attachment point.

13. The apparatus of claim 11, wherein the grip body is cylindrically-shaped and wherein the first portion is a curve-shaped portion with a smaller radius than the second portion, the first portion allowing a user's fingers to wrap around the curve-shaped portion during pulling exercises.

14. The apparatus of claim 11, wherein the grip body is cylindrically-shaped and wherein the second portion is a substantially flat-shaped portion with a larger radius than the first portion, the second portion allowing a user's palm to push on the substantially flat-shaped portion during pushing exercises.

15. A method for using the apparatus of claim 14 comprising:

switching between the first portion for pulling exercises and the second portion for pushing exercises during exercise.

16. The apparatus of claim 11, wherein the multi-profile grip comprises rubber or foam.

17. A method for using the apparatus of claim 11 comprising:

providing the multi-profile grip adapted for exercise equipment comprising the grip body having an elongated shaped adapted for gripping by hand, the grip body having a first portion having a first shape adapted for pulling exercises, and a second portion having a second shape adapted for pushing exercises, wherein the second shape is different than the first shape;

attaching the multi-profile grip to exercise equipment comprising suspension training equipment, strength training equipment, and/or cable-based strength equipment; and switching between the first portion for pulling exercises and the second portion for pushing exercises during exercise.

18. The method of claim 17, wherein the multi-profile grip comprises a cylindrically shaped body comprising rubber and/or foam.

19. The method of claim 18, wherein the first portion is a curve-shaped portion with a smaller radius than the second portion, the first portion allowing a user's fingers to wrap around the curve-shaped portion during pulling exercises, and wherein the second portion is a substantially flat-shaped portion with a larger radius than the first portion, the second portion allowing a user's palm to push on the substantially flat-shaped portion during pushing exercises.

20. The apparatus of claim 11, wherein the fitness cable comprises a ball shank at a terminal end, the ball shank being adapted to fit into the first hole of the U-bracket and having a radius that is larger than a width of the slot;

wherein the U-bracket is configured to rotate facilitating travel of the fitness cable along the slot into an installed position in which the U-bracket is secured to the fitness cable via the ball shank; and wherein the housing is adapted to hold the U-bracket therein while allowing the fitness cable to pass through the top opening which comprises a radiused surface adapted to mitigate bending stress on the fitness cable during use.

* * * * *